US011352868B2

(12) United States Patent
Beisel et al.

(10) Patent No.: US 11,352,868 B2
(45) Date of Patent: Jun. 7, 2022

(54) PULSED DELIVERY OF CONCENTRATED PROPPANT STIMULATION FLUID

(71) Applicant: Halliburton Energy Services, Inc., Houston, TX (US)

(72) Inventors: Joe A. Beisel, Duncan, OK (US); Stanley V. Stephenson, Duncan, OK (US); Glenn Howard Weightman, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 620 days.

(21) Appl. No.: 16/347,659

(22) PCT Filed: Dec. 9, 2016

(86) PCT No.: PCT/US2016/065711

§ 371 (c)(1),
(2) Date: May 6, 2019

(87) PCT Pub. No.: WO2018/106252

PCT Pub. Date: Jun. 14, 2018

(65) Prior Publication Data

US 2019/0316456 A1 Oct. 17, 2019

(51) Int. Cl.
*E21B 43/267* (2006.01)
*F04B 23/04* (2006.01)
(Continued)

(52) U.S. Cl.
CPC ..... *E21B 43/267* (2013.01); *F04B 23/04* (2013.01); *F04B 47/00* (2013.01); *F04B 49/06* (2013.01); *F04B 2205/09* (2013.01)

(58) Field of Classification Search
CPC ..... E21B 43/267; F04B 23/04; F04B 47/00; F04B 49/06; F04B 2205/09
See application file for complete search history.

(56) References Cited

U.S. PATENT DOCUMENTS 8,960,293 B2 2/2015 Olegovich et al.
2013/0105166 A1* 5/2013 Medvedev ..... E21B 43/267 166/305.1

(Continued)

FOREIGN PATENT DOCUMENTS

WO 2015/134022 A1 9/2015

OTHER PUBLICATIONS

International Search Report and Written Opinion issued in related PCT Application No. PCT/US2016/065711 dated Aug. 16, 2017, 17 pages.

*Primary Examiner* — James G Sayre
(74) *Attorney, Agent, or Firm* — Conley Rose, P.C.; Rodney B. Carroll

(57) ABSTRACT

One or more wellbore servicing operations may require the pulsed delivery of a wellbore servicing fluid. To optimize efficiency and effectives of a given wellbore servicing operation a concentrated proppant stimulation fluid may be pumped downhole at a predetermined time interval from dedicated pumping units or positive displacement pumps. The flow rate of proppant in the concentrated proppant stimulation fluid pumped from these dedicated pumps may simulate a square-wave. The desired or determined square-wave or output may be predetermined and any one or more dedicated pumps may be associated with a given time interval and pumping cycle or phasing such that the overall flow of proppant from all of the dedicated pumps simulates a square-wave. Clean fluid from one or more clean fluid pumps may be combined with the concentrated proppant stimulation fluid to maintain a target flow rate of fluid downhole.

18 Claims, 4 Drawing Sheets

(51) Int. Cl.
*F04B 47/00* (2006.01)
*F04B 49/06* (2006.01)

(56) References Cited

U.S. PATENT DOCUMENTS

| | | | | |
|---|---|---|---|---|
| 2014/0352954 | A1 | 12/2014 | Lakhtychkin et al. | |
| 2015/0083400 | A1 | 3/2015 | Stephenson et al. | |
| 2015/0101806 | A1* | 4/2015 | Surjaatmadja ..... | E21B 33/068 166/280.1 |
| 2015/0167443 | A1 | 6/2015 | Litvinets et al. | |
| 2016/0024903 | A1 | 1/2016 | Medvedev et al. | |

* cited by examiner

Proppant Concentration - Harmonics And Total

1st

3rd

5th

7th

Total
Time
Time
Time
Time
Time

PULSED DELIVERY OF CONCENTRATED PROPPANT STIMULATION FLUID

CROSS-REFERENCE TO RELATED APPLICATION

The present application is a U.S. National Stage Application of International Application No. PCT/US2016/065711 filed Dec. 9, 2016, which is incorporated herein by reference in its entirety for all purposes.

TECHNICAL FIELD OF THE INVENTION

The present disclosure relates generally to optimized delivery of stimulation fluid downhole, and more particularly to the pulsed delivery of concentrated proppant stimulation fluid to optimize one or more downhole operations.

BACKGROUND

To produce hydrocarbons (for example, oil, gas, etc.) from a subterranean formation, wellbores may be drilled that penetrate hydrocarbon-containing portions of the subterranean formation. The portion of the subterranean formation from which hydrocarbons may be produced is commonly referred to as a "production zone." In some instances, a subterranean formation penetrated by the wellbore may have multiple production zones at various locations along the wellbore.

Generally, after a wellbore has been drilled to a desired depth, completion operations are performed. Such completion operations may include inserting a liner or casing into the wellbore and, at times, cementing the casing or liner into place. Once the wellbore is completed as desired (lined, cased, open hole, or any other known completion), a stimulation operation may be performed to enhance hydrocarbon production into the wellbore. Examples of some common stimulation operations involve hydraulic fracturing, acidizing, fracture acidizing, and hydrajetting. Stimulation operations are intended to increase the flow of hydrocarbons from the subterranean formation surrounding the wellbore into the wellbore itself so that the hydrocarbons may then be produced up to the wellhead.

One typical formation stimulation process may involve hydraulic fracturing of the formation and placement of a proppant in those fractures. Typically, a stimulation fluid (comprising at least a clean fluid and a proppant) is mixed at the surface before being pumped downhole in order to induce fractures or perforations in the formation of interest. The creation of such fractures or perforations will increase the production of hydrocarbons by increasing the flow paths in to the wellbore.

Oftentimes well operators attempt to "pillar frack" the formation, which involves introducing pulses or plugs of proppant into the clean fluid cyclically, thereby providing the target production zone with a step-changed stimulation fluid. In theory, the step-changed fracturing fluid creates strategically placed proppant pillars within the fractured formation, thereby enhancing conductivity. Ideally, the transition from the clean fluid to a mixture of clean fluid and proppant is an abrupt or sharp step-change. However, conventional methods of mixing the proppant and clean fluid often result in a spreading of the transition between the clean fluid and the proppant, thereby leading to a gradual transition rather than an optimized step-change.

BRIEF DESCRIPTION OF THE DRAWINGS

These drawings illustrate certain aspects of some of the embodiments of the present disclosure, and should not be used to limit or define the claims.

Figure 1:
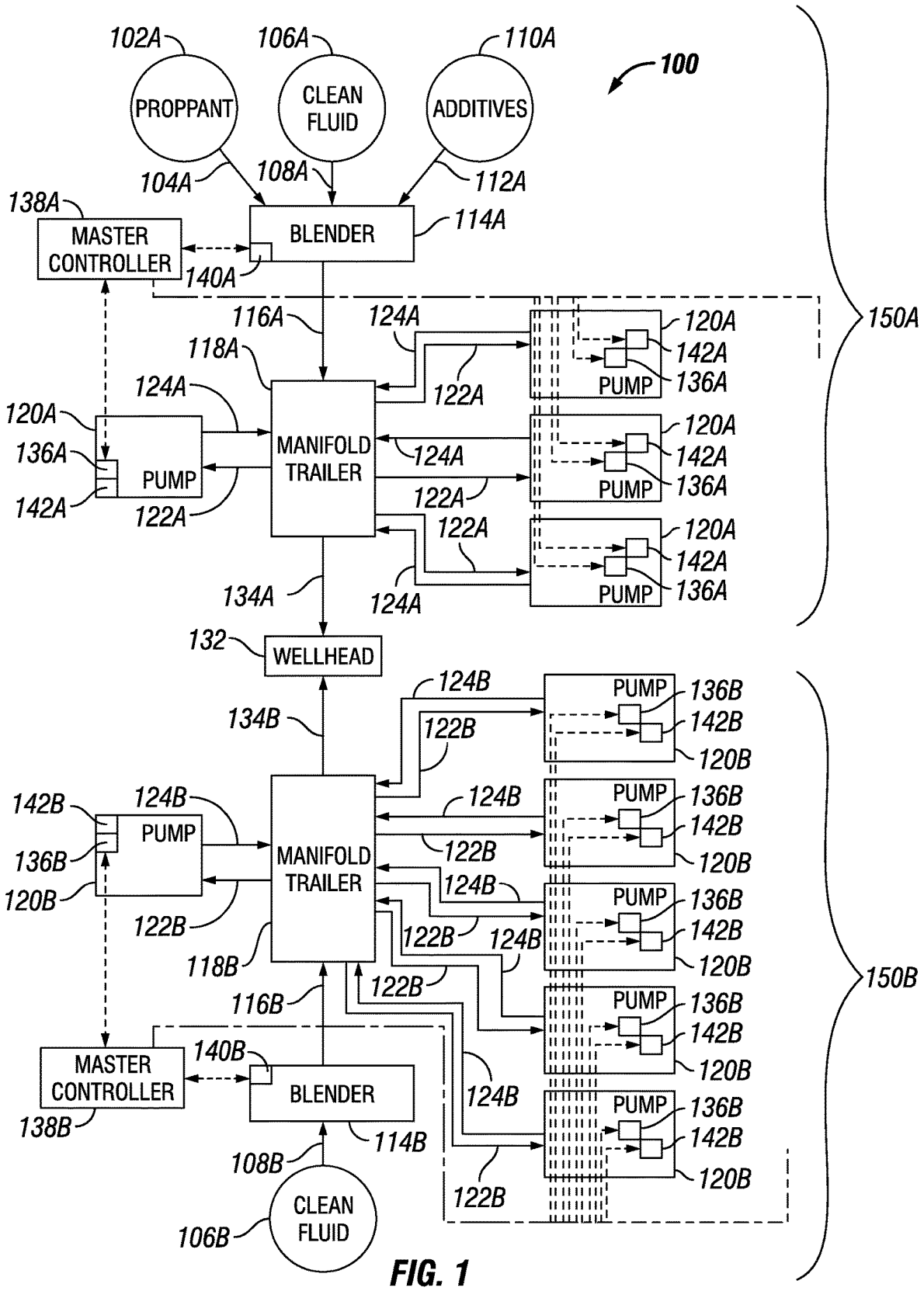
FIG. 1 is a schematic view of a wellbore servicing system, according to one or more aspects of the present invention.

While embodiments of this disclosure have been depicted, such embodiments do not imply a limitation on the disclosure, and no such limitation should be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

Illustrative embodiments of the present disclosure are described in detail herein. In the interest of clarity, not all features of an actual implementation are described in this specification. It will of course be appreciated that in the development of any such actual embodiment, numerous implementation specific decisions must be made to achieve developers' specific goals, such as compliance with system related and business related constraints, which will vary from one implementation to another. Moreover, it will be appreciated that such a development effort might be complex and time consuming, but would nevertheless be a routine undertaking for those of ordinary skill in the art having the benefit of the present disclosure. Furthermore, in no way should the following examples be read to limit, or define, the scope of the disclosure.

The present disclosure relates to delivery of stimulation fluid to a location, for example, downhole, and more particularly to pulsed delivery of concentrated proppant stimulation fluid to a wellbore. Proppant generally refers to any mixture comprising one or more granular solids such as sized sand, resin-coated sand, sintered bauxite beads, metal beads or balls, ceramic particles, glass beads, polymer resin beads, or bio-degradable materials such as ground nut shells and the like. In certain embodiments, the proportion of biodegradable proppant may be in the range of 5-90%, as designed by the user of the process. Proppant may be considered an abrasive mixture such that equipment that engages or utilizes proppant may experience wear and require maintenance. Restricting the exposure of equipment to proppant may increase the life of the equipment and decrease cost of operation.

To perform a pillar-fracturing operation, the stimulation fluid (which typically includes a clean fluid, proppant and a chemical additive) is pumped downhole or in a wellbore using specific control waveforms. As a result, each pump is exposed to the abrasive properties of the proppant. The present disclosure provides systems and methods for delivering concentrated proppant stimulation fluid using a subset of the available pumps so as to minimize exposure of equipment to the abrasive and harsh effects of the proppant while producing an optimized pulsed delivery of the concentrated proppant stimulation fluid. One or more manifold trailers are configured with one or more pumps that are flowed either concentrated proppant stimulation fluid or clean fluid. In one or more embodiments, the proppant stimulation fluid may be diluted with essentially a clean fluid. The concentrated proppant stimulation fluid is pumped at pulsed intervals to simulate a square-wave delivery of the proppant. Such a simulated square-wave pulsation of the proppant may result in an optimized stimulation or a pillar fracturing operation to effectively and efficiently obtain production of hydrocarbons from the wellbore.

While the disclosed methods and apparatus are discussed in terms of a manifold trailer for use in a hydrocarbon production operation, the same principles and concepts may be equally employed for delivering essentially square-wave pulsed delivery of proppant in any field or technology that involves or requires pumping of such type of fluid.

The present disclosure may be understood with reference to FIG. 1, where like numbers are used to indicate like and corresponding parts. For example, like numbers followed by "A" or "B" may be used to indicate like and corresponding parts. FIG. 1 is a schematic view of the pumping apparatus 100 in accordance with one or more embodiments of the present disclosure. The pumping apparatus 100 is configured for servicing of a wellbore to produce hydrocarbons. For example a servicing operation may comprise flowing or pumping a wellbore services fluid, for example, a stimulation fluid, downhole into a wellbore or flowing or pumping proppant (particle-laden fluid) into a portion of a subterranean hydrocarbon formation at a sufficient pressure and velocity to cut a casing, create perforation tunnels, form and extend fractures within the subterranean hydrocarbon formation or any combination thereof. A stimulation fluid may comprise proppant to keep the fractures open so that hydrocarbons may be produced from the subterranean hydrocarbon formation and flow into the wellbore.

As illustrated in FIG. 1, a pumping apparatus 100 may comprise a stimulation fluid pumping system 150A and a clean fluid pumping system 150B. The stimulation fluid pumping system 150A may comprise one or more pumps 120A for pumping concentrated proppant stimulation fluid. The clean fluid pumping system 150B may comprise one or more pumps 120B for pumping a clean fluid or substantially clean fluid. The pumping apparatus 100 may include one or more master controllers 138A and 138B (collectively, master controller 138), one or more blender apparatuses 114A and 114B (collectively, blender apparatus 114) that is coupled to one or more manifold trailers 118A and 118B (collectively, manifold trailer 118) via one or more flow lines 116A and 116B (collectively, flow line 116). Master controller 138 may comprise one or more information handling systems (such as the information handling system 200 described with respect to FIG. 2) comprising one or more programs or instructions that when executed by a processor cause the processor to perform any one or more aspects of any one or more embodiments. For example, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communication with external devices as well as various input and output (I/O) devices, such as a keyboard, a mouse, and a video display. The information handling system may also include one or more buses operable to transmit communications between the various hardware components. The information handling system may also include one or more interface units capable of transmitting one or more signals to a controller, actuator, or like device.

For the purposes of this disclosure, computer-readable media may include any instrumentality or aggregation of instrumentalities that may retain data and/or instructions for a period of time. Computer-readable media may include, for example, without limitation, storage media such as a direct access storage device (for example, a hard disk drive or floppy disk drive), a sequential access storage device (for example, a tape disk drive), compact disk, CD-ROM, DVD, RAM, ROM, electrically erasable programmable read-only memory (EEPROM), and/or flash memory; as well as communications media such wires, optical fibers, microwaves, radio waves, and other electromagnetic and/or optical carriers; and/or any combination of the foregoing.

In one or more embodiments, a stimulation fluid pumping system 150A and a clean fluid pumping system 150B may comprise a manifold trailer 118A and manifold trailer 118B, respectively. Stimulation fluid pumping system 150A and clean fluid pumping system 150B may comprise the same manifold trailer 118 or each may comprise one or more different manifold trailers, for example, manifold trailer 118A and manifold trailer 118B, respectively. A manifold trailer 118 may include a truck, trailer or both comprising one or more pump manifolds (not shown) for receiving, organizing, distributing, or any combination thereof wellbore servicing fluids, for example, a stimulation fluid, during wellbore servicing operations. A manifold trailer 118 may be coupled to one or more pumps 120 (for example, one or more pumps 120A and one or more pumps 120B) via one or more outlet flow lines 122A and 112B (collectively, outlet flow lines 122) and one or more inlet flow lines 124A and 124B (collectively, inlet flow lines 124). In one or more embodiments, pump 120 may comprise a positive displacement pump. Outlet flow lines 122 may supply fluid to the pumps 120 from the manifold trailer 118. Inlet flow lines 124 may supply fluids to the manifold trailer 118 from the pumps 120. The manifold trailer 118 generally has manifold outlets (not shown) from which a fluid is flowed to a location, for example, any one or more wellbore servicing fluids may be flowed to a wellhead 132 via one or more flow lines 134A and 134B (collectively flow line 134).

A blender apparatus (for example, blender apparatus 114A and blender apparatus 114B, collectively blender apparatus 114) flows wellbore servicing fluid to manifold trailer 118. One or more blender monitors 140A and 140B (collectively, blender monitor 140) monitors various operational characteristics of the blender 114. The blender apparatus 114 mixes solids, fluids or both to achieve a wellbore servicing fluid. In one or more embodiments blender apparatus 114A receives via one or more feed lines 104A, 108A and 112A proppant 102A, clean fluid 106A and one or more additives 110A, respectively. Proppant 102A may comprise a granular solid, such as sand and may be blended with clean fluid 106A to form a servicing fluid or wellbore servicing fluid. Clean fluid 106A may comprise potable water, non-potable water, untreated water, treated water, any other brine, foamed or comingled brines with carbon dioxide or nitrogen, acid mixtures or hydrocarbon based or other emulsion fluids. Generally, clean fluid does not comprise or include a significant amount of proppant or other solid material suspended therein. One or more additives 110A may comprise any one or more of a gelling agent that may comprise substantially any of the viscosifying compounds known to function in the desired manner (for example, the gelling agent may comprise, for example, substantially any polysaccharide polymer viscosifying agent such as guar gum, derivatized guars such as hydroxypropylguar, derivatized cellulosics such as hydroxyethylcellulose, derivatives of starch, polyvinyl alcohols, acrylamides, xanthan gums, and the like), any other chemical or other additive that acts as a carrier for the proppant 102A. Blender apparatus 114A combines one or more proppants 102A, clean fluid 106A, additive 110A and any other fluid or material to form a concentrated proppant stimulation fluid. In one or more embodiments blender apparatus 114B receives clean fluid 106B from one or more feed lines 108B and any other fluid or material to form a clean servicing fluid that does not include a proppant or abrasive material. In one or more embodiments, one or more pumps 120A receive a concentrated proppant stimulation fluid from the manifold 118A and one or more pumps 120B receive a clean well servicing fluid. In one or more embodiments, blender apparatus 114 and clean 106B is not necessary as one or more of the pumps 120B may be coupled directly to the clean fluid 106A.

Each pump 120 may comprise one or more pumps 120 such that each pump 120 forms a single pump or a group of pumps. Each pump 120 may comprise one or more pump monitors 136A and 136B (collectively, pump monitor 136). Pump monitor 136 may monitor one or more operation characteristics of the pump 120. The pump monitor 136 and the blender monitor 140 may each provide information to a master controller 138 that is in communication with the pump monitor 136 and a blender monitor 140. For example, pump monitor 136 may provide information associated with the flow rate and position of pump 120. Each pump 120 may be further coupled to one or more engines or actuators 142A and 142B (collectively, engine 142), which actuates the movement of the pump 120. The master controller 138 may be communicatively coupled to each engine 142. The engine 142 may comprise a processor, a memory, and a receiver such that the actuator may receive one or more commands sent by the master controller 138. The one or more commands may cause the engine 142 to change the flow rate of the pump 120.

Engine 142 may comprise any one or more engines. While each pump 120 is illustrated as comprising an engine 142, the present disclosure contemplates any two or more pumps 120 coupled to an engine 142 such that the two or more pumps are sourced with a single power source. Engine 142A may comprise an electric motor or any other motor having characteristics that allow for ramp-up and ramp-down speed control sufficient to simulate a sine-wave. Engine 142B may comprise any type of engine suitable for a wellbore services operation including, but not limited to, an electric motor, a turbine engine, and any engine that operates using any given fuel type (for example, natural gas, gasoline, and diesel). Engine 142 may be communicatively coupled to master controller 138. Engine 142 may transmit or send information to master controller 138 associated with the operation of the engine 142 including, but not limited, to the speed of the engine 142. Master controller 138 may transmit or send one or more commands to engine 142 to increase or decrease the speed of engine 142 to increase or decrease the rate of pumping. In one or more embodiments, master controller 138A may transmit one or more commands to engine 142A that cause engine 142A to decrease speed to a predetermined speed for a predetermined interval of time and then increase speed to a predetermined speed for a predetermined interval of time such that the output power from engine 142B simulates a sine-wave. In one or more embodiments, master controller 138B may transmit one or more commands to engine 142B to maintain a constant speed for a predetermined interval or time or to maintain a constant speed continuously during a wellbore servicing operation.

Figure 2:
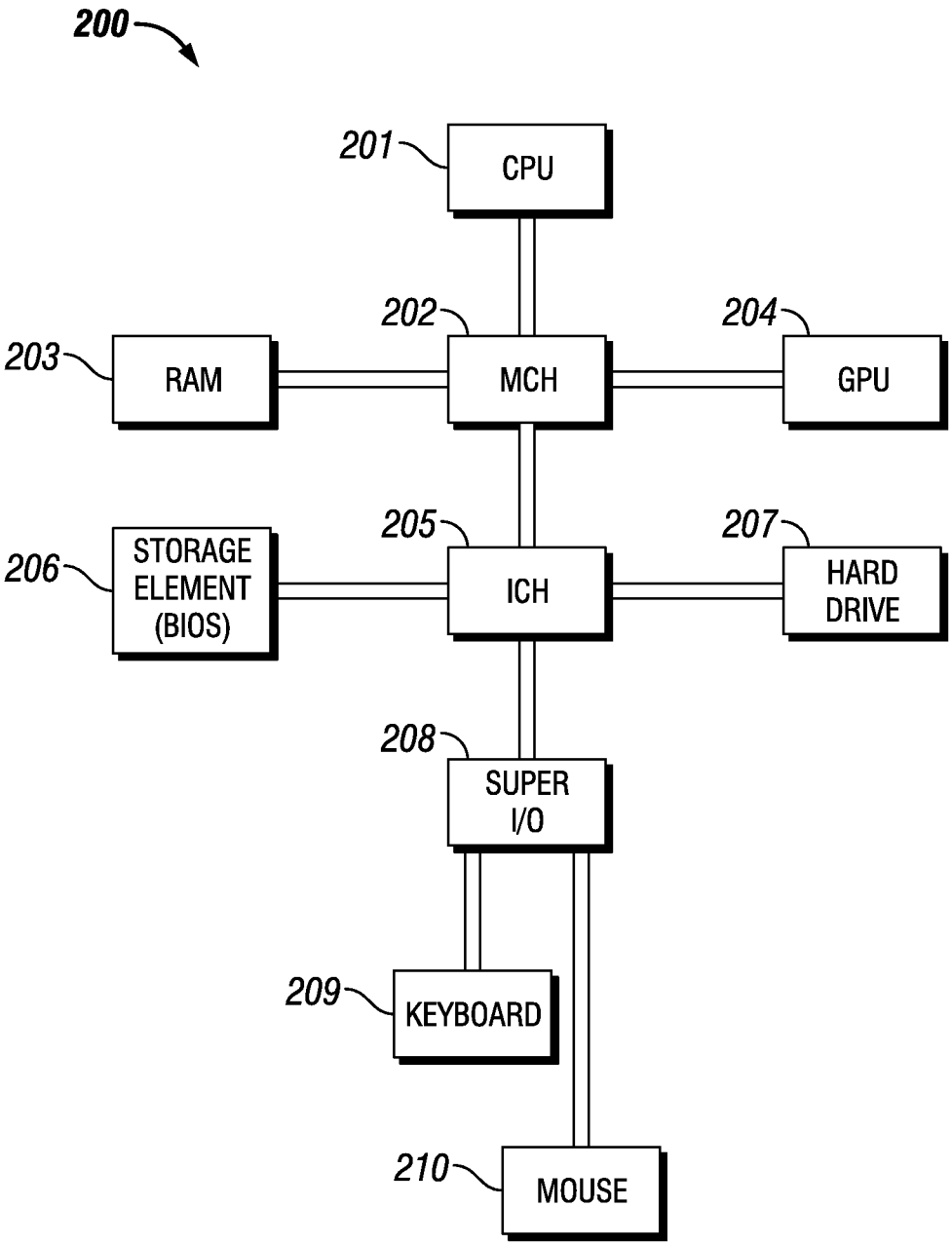
FIG. 2 is a diagram illustrating an example information handling system, according to one or more aspects of the present disclosure.

FIG. 2 is a diagram illustrating an example information handling system 200, according to aspects of the present disclosure. One or more master controllers 138A and 138B may take a form similar to the information handling system 200 or include one or more components of information handling system 200. A processor or central processing unit (CPU) 201 of the information handling system 200 is communicatively coupled to a memory controller hub (MCH) or north bridge 202. The processor 201 may include, for example a microprocessor, microcontroller, digital signal processor (DSP), application specific integrated circuit (ASIC), or any other digital or analog circuitry configured to interpret and/or execute program instructions and/or process data. Processor 201 may be configured to interpret and/or execute program instructions or other data retrieved and stored in any memory such as memory 203 or hard drive 207. Program instructions or other data may constitute portions of a software or application for carrying out one or more methods described herein. Memory 203 may include read-only memory (ROM), random access memory (RAM), solid state memory, or disk-based memory. Each memory module may include any system, device or apparatus configured to retain program instructions and/or data for a period of time (for example, computer-readable non-transitory media). For example, instructions from a software or application may be retrieved and stored in memory 203 for execution by processor 201.

Modifications, additions, or omissions may be made to FIG. 2 without departing from the scope of the present disclosure. For example, FIG. 2 shows a particular configuration of components of information handling system 200. However, any suitable configurations of components may be used. For example, components of information handling system 200 may be implemented either as physical or logical components. Furthermore, in some embodiments, functionality associated with components of information handling system 200 may be implemented in special purpose circuits or components. In other embodiments, functionality associated with components of information handling system 200 may be implemented in configurable general purpose circuit or components. For example, components of information handling system 200 may be implemented by configured computer program instructions.

Memory controller hub 202 may include a memory controller for directing information to or from various system memory components within the information handling system 200, such as memory 203, storage element 206, and hard drive 207. The memory controller hub 202 may be coupled to memory 203 and a graphics processing unit (GPU) 204. Memory controller hub 202 may also be coupled to an I/O controller hub (ICH) or south bridge 205. I/O controller hub 205 is coupled to storage elements of the information handling system 200, including a storage element 206, which may comprise a flash ROM that includes a basic input/output system (BIOS) of the computer system. I/O controller hub 205 is also coupled to the hard drive 207 of the information handling system 200. I/O controller hub 205 may also be coupled to a Super I/O chip 208, which is itself coupled to several of the I/O ports of the computer system, including keyboard 209 and mouse 210.

In certain embodiments, the master controller 138 may comprise an information handling system 200 with at least a processor and a memory device coupled to the processor that contains a set of instructions that when executed cause the processor to perform certain actions. In any embodiment, the information handling system may include a non-transitory computer readable medium that stores one or more instructions where the one or more instructions when executed cause the processor to perform certain actions. As used herein, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a computer terminal, a network storage device, or any other suitable device and may vary in size, shape, performance, functionality, and price. The information handling system may include random access memory (RAM), one or more processing resources such as a central processing unit (CPU) or hardware or software control logic, read only memory (ROM), and/or other types of nonvolatile memory. Additional components of the information handling system may include one or more disk drives, one or more network ports for communication with external devices as well as various input and output (I/O) devices, such as a keyboard, a mouse, and a video display. The information handling system may also include one or more buses operable to transmit communications between the various hardware components.

Figure 3:
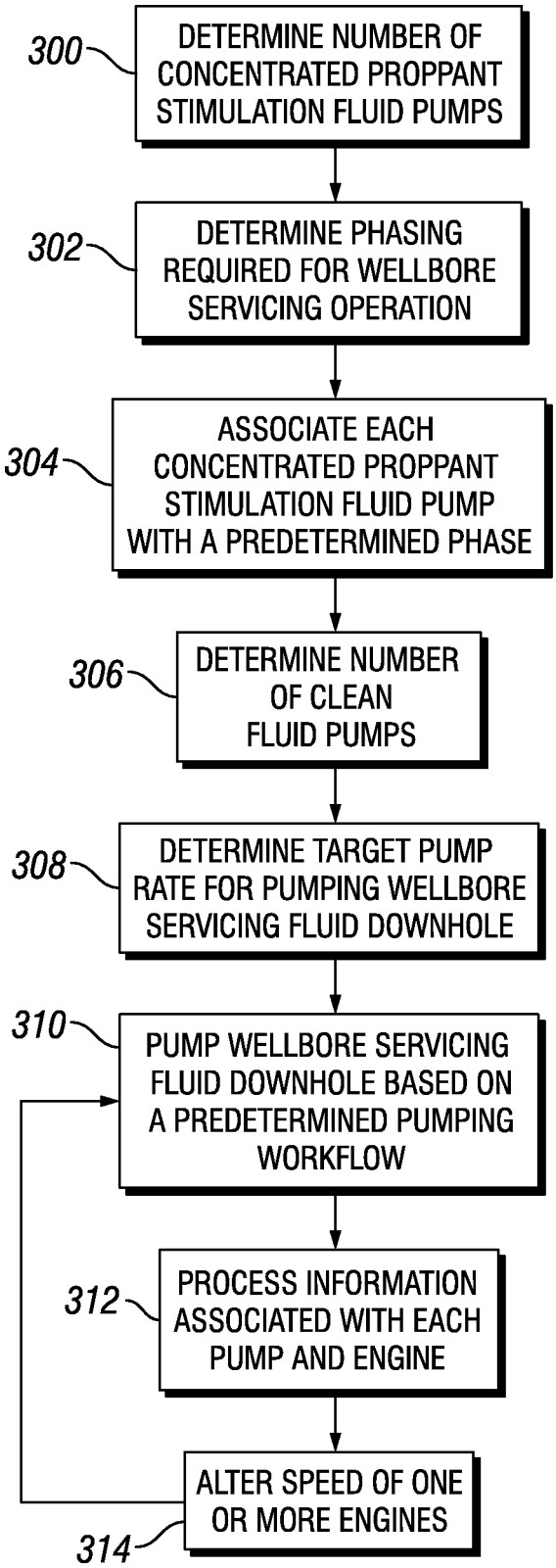
FIG. 3 illustrates a flowchart of an example pulsed delivery of concentrated proppant fluid downhole into a wellbore.

FIG. 3 illustrates a flowchart of an example pulsed delivery of concentrated proppant fluid downhole into a wellbore. In one or more operations, a fluid may be pumped to a location at a predetermined rate. For example, in one or more well servicing operations, wellbore servicing fluid may be pumped downhole at a predetermined flow rate so as to maintain a desired rate of the wellbore servicing fluid in the wellbore. The well servicing operation may require that the wellbore servicing fluid pumped at a given time comprises a concentration of proppant (for example, a stimulation fluid). For example, a well servicing operation may comprise the injection of a stimulation fluid downhole to create or prop open a perforation or fracture in one or more portions of the formation surrounding the wellbore. In one or more embodiments, such creation and propping open of a perforation or fracture is optimized by pulsing the stimulation fluid downhole where the concentration of the proppant in the stimulation fluid delivered downhole simulates a square-wave.

In one or more embodiments, the number or quantity of concentrated proppant stimulation fluid pumps (for example, pumps 120A in FIG. 1) is determined at step 300. In one or more embodiments, a predetermined concentration of proppant for a concentrated proppant stimulation fluid is determined for a given operation, such as, a pillar fracturing or other stimulation operation. The operation may require that the concentrated proppant stimulation fluid be pumped downhole at a predetermined interval to achieve optimum results. The pulsed interval and rate of pumping may correlate to a square-wave of a Fourier transform. The Fourier transform may be decomposed to determine any two or more orders or terms of the Fourier transform. Any one or more of the concentrated proppant stimulation fluid pumps may be associated with each order or term of the predetermined Fourier transform. The quantity of concentrated proppant stimulation fluid pumps may be based, at least in part, on the quantity of pumps associated with each order or term of the predetermined Fourier transform.

Figures 4A, 4B, 4C, 4D, 4E:
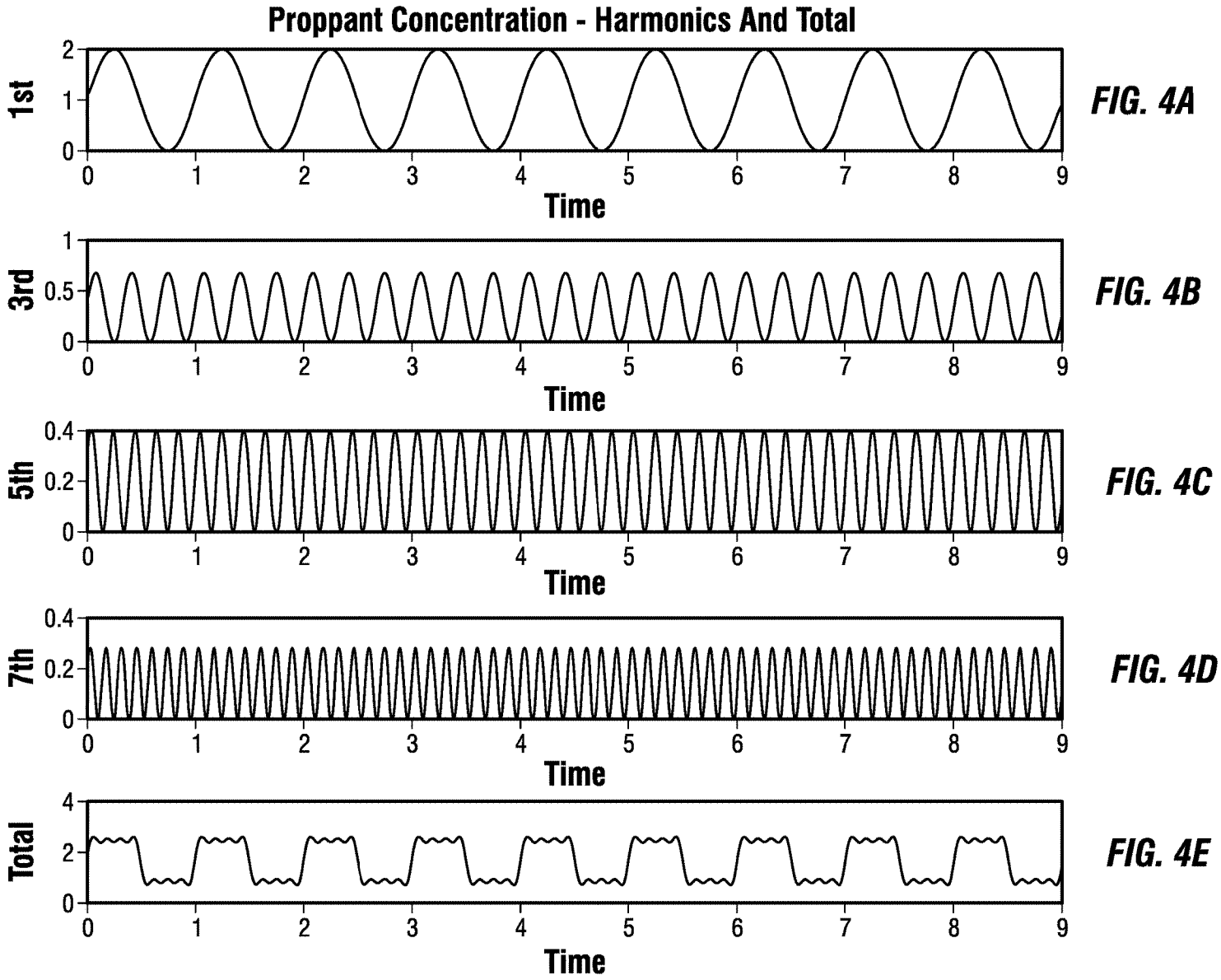
FIG. 4A is a graph illustrating a first phasing for delivery of concentrated proppant downhole, according to one or more aspects of the present disclosure.
FIG. 4B is a graph illustrating a second phasing for delivery of concentrated proppant downhole, according to one or more aspects of the present disclosure.
FIG. 4C is a graph illustrating a third phasing for delivery of concentrated proppant downhole, according to one or more aspects of the present disclosure.
FIG. 4D is a graph illustrating a fourth phasing for delivery of concentrated proppant downhole, according to one or more aspects of the present disclosure.
FIG. 4E is a graph illustrating a simulated square wave for delivery of concentrated proppant downhole, according to one or more aspects of the present disclosure.

At step 302, the phasing of the concentrated proppant stimulation fluid pumps is determined. The phasings determine the pumping cycle for a given concentrated proppant stimulation fluid pump. For example, for a pillar fracturing wellbore services operation, concentrated proppant stimulation fluid comprising a predetermined concentration of proppant may be required to be pumped downhole at a predetermined pulsed interval. Such a pillar fracturing wellbore servicing operation may require that the concentrated proppant stimulation fluid be pumped downhole at a flow rate such that the pumped proppant of the concentrated proppant stimulation fluid delivered downhole simulates the square-wave of the predetermined Fourier transform illustrated in FIG. 4E. In one or more embodiments, to obtain the required phasing, a four term decomposition of the Fourier transform is generated as illustrated in FIGS. 4A-4D. In one or more embodiments, more or less terms in the Fourier decomposition may be used than that illustrated in FIGS. 4A-4D. To obtain the square-wave of the predetermined Fourier transform, for example, as illustrated in FIG. 4E, at least four concentrated proppant stimulation fluid pumps are required. In one or more embodiments, each order or term of a decomposition of a predetermined Fourier transform may be associated with any number of concentrated proppant stimulation fluid pumps. Any phasing may be utilized such that at any given time interval any concentration of proppant of the concentrated proppant stimulation fluid may be pumped downhole.

At step 304, each concentrated proppant stimulation fluid pump is associated with a predetermined phase and rate. For example, a first one or more concentrated proppant stimulation fluid pumps may be associated with a first phasing and a first rate, for example, the phasing and rate illustrated in FIG. 4A, a second one or more concentrated proppant stimulation fluid pumps may be associated with a second phasing and a second rate, for example, the phasing and rate illustrated in FIG. 4B, a third one or more concentrated proppant stimulation fluid pumps may be associated with a third phasing and a third rate, for example, the phasing and rate illustrated in FIG. 4C, and a fourth one or more concentrated proppant stimulation fluid pumps may be associated with a fourth phasing and a fourth, for example, the phasing and rate illustrated in FIG. 4D. In one or more embodiments, any number of concentrated proppant stimulation fluid pumps may be associated with any number of phasings and any number of corresponding rates.

At step 306, the number or quantity of clean fluid pumps (for example, pump 120B in FIG. 1) is determined. At step 308, it the target flow rate for pumping a fluid, such as a wellbore servicing fluid, to a location or downhole is determined. In one or more embodiments, the quantity of clean fluid pumps and the quantity of concentrated proppant stimulation pumps may be based, at least in part, on the target flow rate.

At step 310, the wellbore servicing fluid is pumped downhole based, at least in part, on a predetermined pumping workflow. The predetermined pumping workflow is based at least in part, on any one or more of the determined quantity of concentrated proppant stimulation fluid pumps, the determined quantity of clean fluid pumps, the target flow rate and the determined phasing (for example, the determined phasing to achieve the desired pillar fracturing). In one or more embodiments, one or more concentrated proppant stimulation fluid pumps are operated at a phasing to pump the concentrated proppant stimulation fluid at a rate as illustrated in FIGS. 4A-D. To obtain the target flow rate, one or more clean fluid pumps or one or more additional clean fluid pumps may also pump clean fluid downhole during any pumping cycle of any one or more of the concentrated proppant stimulation fluid pumps such that the total fluid or the wellbore servicing fluid pumped downhole comprises concentrated proppant stimulation fluid and clean fluid at a desired rate. In one or more embodiments, any one or more clean fluid pumps (or auxiliary clean fluid pumps) may only be actuated to maintain the flow rate of wellbore servicing fluid downhole at the target flow rate and one or more clean fluid pumps are actuated continuously for a given wellbore servicing operation. For example, a first one or more clean fluid pumps may be actuated or caused to pump a clean fluid during any pump cycle or phasing of one or more concentrated proppant stimulation fluid pumps and a second one or more clean fluid pumps (or auxiliary clean fluid pumps) may be actuated or caused to pump a clean fluid when the pump cycle or phasing of the one or more concentrated proppant stimulation fluid pumps does not produce a sufficient flow rate to maintain the target flow rate.

At step 312, information from a pump monitor 136 (discussed with respect to FIG. 1) or any other sensor associated with any one or more of a pump (for example, a pump 120 of FIG. 1), an engine (for example, an engine 136 of FIG. 1) and any other device or equipment at the pumping apparatus 100 may be communicated or transmitted to an information handling system, such as master controller 138 (in FIG. 1), for processing. For example, master controller 138 may process the information to determine if one or more clean fluid pumps should be actuated (for example, if the flow rate is not at the target flow rate one or more auxiliary or additional clean fluid pumps may be actuated), if one or more concentrated proppant stimulation fluid pumps associated with a given phasing or order should be actuated, or any combination thereof. For example, the delivery of a pulsed concentrated proppant stimulation fluid, clean fluid or both downhole results in the rate of overall total fluid (for example, combined pulsed concentrated proppant stimulation fluid and clean fluid) being pumped downhole having a determined pulsation. When the proppant in the concentrated proppant stimulation fluid comprises a small portion of the overall total of fluid pumped downhole, the pulsation will be smaller rather than larger and likewise when the proppant in the concentrated proppant stimulation fluid comprises a large portion of the overall total of fluid pumped downhole the pulsation will be larger rather than smaller. In one or more embodiments, a desirable or determined pulsation may not be obtained when the quantity of proppant is at or about half the total of the fluid pumped downhole. To avoid this undesirable pulsation or state or to obtain the determined pulsation, the same number of clean fluid pumps (for example, one or more pumps 120B in FIG. 1) and concentrated proppant stimulation fluid pumps (for example, one or more pumps 120A in FIG. 1) may be used. The pumping rates for the one or more clean fluid pumps and the concentrated proppant stimulation fluid pumps should match in sinusoidal frequency but should differ in phase such that the fluids pumped from the different types of pumps when combined are 180 degrees out of phase from each other. In one or more embodiments, one or more additional clean pumps (for example, one or more pumps 120B in FIG. 1) may pump fluid at a constant rate to maintain a predetermined rate of overall pumped fluid. For example, the concentration of proppant in the concentrated proppant stimulation fluid may be any level of concentration and may be pumped by any quantity of one or more concentrated proppant stimulation fluid pumps at a first rate and first phasing, one or more clean fluid pumps may pump clean fluid at a second rate and second phasing, and one or more additional clean fluid pumps may pump clean fluid at a constant rate such that the total or combination of the fluid pumped downhole is at a predetermined rate or a target flow rate.

At step 314, the master controller 138 may alter the speed of one or more engines (for example, engines 136) to alter the flow rate of any of one or more concentrated proppant stimulation fluid pumps, one or more clean fluid pumps, one or more auxiliary or additional clean fluid pumps, or any combination thereof to maintain the target flow rate. In one or more embodiments, one or more additional clean fluid pumps (for example, clean fluid pumps 120B of FIG. 1) may be brought on line to pump clean fluid at a constant rate to maintain the target flow rate or the predetermined rate. In one or more embodiments, any one or more of the rate of pumping of one or more concentrated proppant stimulation fluid pumps, one or more clean fluid pumps or one or more additional clean fluid pumps may be increased to maintain the target flow rate or the predetermined rate. In one or more embodiments, the concentration of proppant in the concentrated proppant stimulation fluid is altered such that the proppant in the concentrated proppant stimulation fluid pumped to the location or downhole simulates a square-wave associated with a pre-determined Fourier transform.

The method continues at step 310 until the wellbore services operation is completed, interrupted or otherwise halted or stopped. In one or more embodiments, any steps illustrated in FIG. 3 may be performed in any order or any one or more steps may not be performed.

FIG. 4A is a graph illustrating a first phasing for delivery of concentrated proppant downhole, according to one or more aspects of the present disclosure. The x-axis labeled "Time" denotes a time. The time may be any unit of measurement of time. The y-axis labeled "1st" denotes a first order of a decomposition of a predetermined Fourier transform where the delivery of concentrated proppant ranges from an order of magnitude of "0" to "2".

FIG. 4B is a graph illustrating a second phasing for delivery of concentrated proppant downhole, according to one or more aspects of the present disclosure. The x-axis labeled "Time" denotes a time. The time may be any unit of measurement of time. The y-axis labeled "3rd" denotes a third order of a decomposition of a predetermined Fourier transform where the delivery of concentrated proppant ranges from an order of magnitude of "0" to "1".

FIG. 4C is a graph illustrating a fifth phasing for delivery of concentrated proppant downhole, according to one or more aspects of the present disclosure. The x-axis labeled "Time" denotes a time. The time may be any unit of measurement of time. The y-axis labeled "5th" denotes a fifth order of a decomposition of a predetermined Fourier transform where the delivery of concentrated proppant ranges from an order of magnitude of "0" to "0.4".

FIG. 4D is a graph illustrating a seventh phasing for delivery of concentrated proppant downhole, according to one or more aspects of the present disclosure. The x-axis labeled "Time" denotes a time. The time may be any unit of measurement of time. The y-axis labeled "7th" denotes a seventh order of a decomposition of a predetermined Fourier transform where the delivery of concentrated proppant ranges from an order of magnitude of "0" to "0.4".

FIG. 4E is a graph illustrating a simulated square wave for delivery of concentrated proppant downhole, according to one or more aspects of the present disclosure. The x-axis labeled "Time" denotes a time. The time may be any unit of measurement of time. The y-axis labeled "Total" denotes a combination of the first phasing illustrated in FIG. 4A, the third phasing illustrated in FIG. 4B, the fifth phasing illustrated in FIG. 4C and the seventh phasing illustrated in FIG. 4D which simulates a square-wave where the delivery of concentrated proppant ranges from an order of magnitude of "0" to "4".

A method for pumping a fluid to a location, comprises pumping a clean fluid from one or more clean fluid pumps at a first rate and a first phasing to the location, pumping a concentrated proppant stimulation fluid from one or more concentrated proppant stimulation fluid pumps at a second rate and a second phasing to the location, wherein the concentrated proppant stimulation fluid comprises a concentration of a proppant and maintaining a target flow rate of the fluid pumped to the location by controlling the first rate of the one or more clean fluid pumps and the second rate of the one or more concentrated proppant stimulation fluid pumps, wherein the fluid comprises at least one of the clean fluid and the concentrated proppant stimulation fluid, and wherein the concentration of the proppant in the concentrated proppant stimulation fluid pumped to the location simulates a square-wave. In one or more embodiments, the one or more concentrated proppant stimulation fluid pumps comprises a plurality concentrated proppant stimulation fluid pumps, wherein at least a first one of the plurality of concentrated proppant simulation fluid pumps is associated with a first order of a decomposition of a predetermined Fourier transform and at least a second one of the plurality of concentrated proppant simulation fluid pumps is associated with a second order of the decomposition of the predetermined Fourier transform. In one or more embodiments, the method for pumping the fluid to the location further comprises pumping an additional clean fluid at a constant rate from one or more additional clean fluid pumps to maintain the target flow rate of the fluid pumped to the location. The method for pumping the fluid to the location further comprises pumping the clean fluid from the one or more clean fluid pumps to the location via a manifold, pumping the concentrated proppant stimulated fluid from the one or more concentrated proppant stimulated fluid pumps to the location via the manifold and wherein the fluid is pumped to the location via the manifold. In one or more embodiments, the method for pumping the fluid to the location further comprises altering at least one of the first rate and the second rate to maintain the target flow rate. In one or more embodiments, the method for pumping the fluid to the location further comprises forming a proppant pillar from the fluid pumped to the location. In one or more embodiments, wherein the first rate of pumping the clean fluid and the second rate of pumping the concentrated proppant stimulation fluid match in sinusoidal frequency, and wherein the first phasing differs from the second phasing.

In one or more embodiments, a pumping system comprises one or more clean fluid pumps, wherein the one or more clean fluid pumps pump a clean fluid at a first rate and a first phasing to a location, one or more concentrated proppant stimulation pumps, wherein the one or more concentrated proppant stimulation pumps pump a concentrated proppant stimulation fluid at a second rate and a second phasing to the location, wherein the concentrated proppant stimulation fluid comprises a predetermined concentration of proppant an information handling system coupled to the one or more clean fluid pumps and the one or more concentrated proppant stimulation fluid pumps, wherein the information handling comprises a processor and a non-transitory memory coupled to the processor, the memory containing one or more instructions that, when executed by the processor, cause the processor to maintain a total rate of fluid pumped to the location by controlling the first rate of the one or more clean fluid pumps and the second rate of the one or more concentrated proppant stimulation fluid pumps, wherein the fluid comprises the clean fluid and the concentrated proppant stimulation fluid pumped to the location and control pumping of the concentrated proppant stimulation fluid to the location such that the concentration of the proppant in the concentrated proppant stimulation fluid pumped to the location simulates a square-wave. In one or more embodiments, the one or more concentrated proppant stimulation fluid pumps comprise a plurality concentrated proppant stimulation fluid pumps, wherein the one or more instructions that, when executed by the processor, further cause the processor to associate at least a first one of the plurality of concentrated proppant simulation fluid pumps to a first order of a decomposition of a predetermined Fourier transform and at least a second one of the plurality of concentrated proppant simulation fluid pumps to a second order of the decomposition of the predetermined Fourier transform. In one or more embodiments, the pumping system further comprises one or more additional clean fluid pumps, wherein the one or more additional clean fluid pumps pump a clean fluid to the location to maintain a predetermined rate of the fluid pumped to the location. In one or more embodiments, the pumping system further comprises a manifold coupled between the one or more clean fluid pumps and the location and the one or more concentrated proppant stimulation fluid pumps and the location, wherein the fluid is pumped to the location via the manifold. In one or more embodiments, the location comprises a wellbore. In one or more embodiments, the one or more instructions that, when executed, by the processor cause the processor to maintain the first rate of pumping the clean fluid and the second rate of pumping the concentrated proppant stimulation fluid to match in sinusoidal frequency and maintain the first phasing at a different phasing from the second phasing.

In one or more embodiments, a non-transitory computer readable medium storing one or more instructions that, when executed, cause a processor to determine a decomposition of a predetermined Fourier transform, wherein the predetermined Fourier transform is based on a predetermined concentration of proppant in a concentrated proppant stimulation fluid to be pumped at pulsed intervals to a location to simulate a square-wave, associate one or more concentrated proppant stimulation fluid pumps to each of at least two or more orders of the decomposed predetermined Fourier transform, determine a first rate and a first phasing for pumping a clean fluid from one or more clean fluid pumps, determine a second rate and second phasing for pumping a concentrated proppant stimulation fluid from the one or more concentrated proppant stimulation fluid pumps based on the associated two or more orders of the decomposition of the predetermined Fourier transform and wherein the determined first rate and the second rate are based on a target flow rate of a total fluid to the location, wherein the total fluid comprises at least one of the clean fluid and the concentrated proppant stimulation fluid. In one or more embodiments, the one or more instructions further cause the processor to associate at least a first one of the one or more concentrated proppant stimulation pumps with a first order of the decomposed predetermined Fourier transform and associate at least a second one of the one or more concentrated proppant stimulation pumps with a second order of the decomposed predetermined Fourier transform. In one or more embodiments, the one or more instructions further cause the processor to determine one or more additional clean fluid pumps and associate each of the one or more additional clean fluid pumps with a constant rate. In one or more embodiments, the first phase and the second phase are 180 degrees out of phase. In one or more embodiments, first rate and the second rate are determined such that the pumping of the clean fluid at the first rate and the concentrated proppant stimulation fluid match in sinusoidal frequency. In one or more embodiments, the one or more instructions further cause the processor to determine a flow rate of the fluid to the location and alter at least one of the first rate and the second rate based on the flow rate to maintain the target flow rate. In one or more embodiments, the one or more instructions further cause the processor to actuate at least one of the one or more clean fluid pumps to pump an additional clean fluid to maintain the target flow rate of the fluid to the location.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. While numerous changes may be made by those skilled in the art, such changes are encompassed within the spirit of the subject matter defined by the appended claims. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure.

What is claimed is:

1. A method for pumping a fluid to a location, comprising:

pumping a clean fluid from one or more clean fluid pumps at a first rate and a first phasing to the location;

pumping a concentrated proppant stimulation fluid from one or more concentrated proppant stimulation fluid pumps at a second rate and a second phasing to the location, wherein the concentrated proppant stimulation fluid comprises a concentration of a proppant, wherein at least a first one of the one or more concentrated proppant stimulation fluid pumps is associated with a first order of a decomposition of a predetermined Fourier transform and at least a second one of the one or more concentrated proppant stimulation fluid pumps is associated with a second order of the decomposition of the predetermined Fourier transform; and maintaining a target flow rate of the fluid pumped to the location by controlling the first rate of the one or more clean fluid pumps and the second rate of the one or more concentrated proppant stimulation fluid pumps, wherein the fluid comprises at least one of the clean fluid and the concentrated proppant stimulation fluid, and wherein the concentration of the proppant in the concentrated proppant stimulation fluid pumped to the location simulates a square-wave.

2. The method for pumping the fluid to the location of claim 1, further comprising pumping an additional clean fluid at a constant rate from one or more additional clean fluid pumps to maintain the target flow rate of the fluid pumped to the location.

3. The method for pumping the fluid to the location of claim 1, further comprising:

pumping the clean fluid from the one or more clean fluid pumps to the location via a manifold;

pumping the concentrated proppant stimulation fluid from the one or more concentrated proppant stimulation fluid pumps to the location via the manifold; and wherein the fluid is pumped to the location via the manifold.

4. The method for pumping the fluid to the location of claim 1, further comprising altering at least one of the first rate and the second rate to maintain the target flow rate.

5. The method for pumping the fluid to the location of claim 1, further comprising forming a proppant pillar from the fluid pumped to the location.

6. The method for pumping the fluid to the location of claim 1, wherein the first rate of pumping the clean fluid and the second rate of pumping the concentrated proppant stimulation fluid match in sinusoidal frequency, and wherein a first phasing differs from a second phasing.

7. A pumping system comprising:

one or more clean fluid pumps, wherein the one or more clean fluid pumps pump a clean fluid at a first rate and a first phasing to a location;

one or more concentrated proppant stimulation pumps, wherein the one or more concentrated proppant stimulation pumps pump a concentrated proppant stimulation fluid at a second rate and a second phasing to the location, wherein the concentrated proppant stimulation fluid comprises a predetermined concentration of proppant; and an information handling system coupled to the one or more clean fluid pumps and the one or more concentrated proppant stimulation fluid pumps, wherein the information handling comprises a processor and a non-transitory memory coupled to the processor, the memory containing one or more instructions that, when executed by the processor, cause the processor to:

maintain a total rate of fluid pumped to the location by controlling the first rate of the one or more clean fluid pumps and the second rate of the one or more concentrated proppant stimulation fluid pumps, wherein the fluid comprises the clean fluid and the concentrated proppant stimulation fluid pumped to the location;

associate at least a first one of the one or more concentrated proppant stimulation fluid pumps to a first order of a decomposition of a predetermined Fourier transform and at least a second one of the one or more concentrated proppant stimulation fluid pumps to a second order of the decomposition of the predetermined Fourier transform; and control pumping of the concentrated proppant stimulation fluid to the location such that the concentration of the proppant in the concentrated proppant stimulation fluid pumped to the location simulates a square-wave.

8. The pumping system of claim 7, further comprising one or more additional clean fluid pumps, wherein the one or more additional clean fluid pumps pump a clean fluid to the location to maintain a predetermined rate of the fluid pumped to the location.

9. The pumping system of claim 7, further comprising a manifold coupled between the one or more clean fluid pumps and the location and the one or more concentrated proppant stimulation fluid pumps and the location, wherein the fluid is pumped to the location via the manifold.

10. The pumping system of claim 7, wherein the location comprises a wellbore.

11. The pumping system of claim 7, wherein the one or more instructions that, when executed, by the processor further cause the processor to:

maintain the first rate of pumping the clean fluid and the second rate of pumping the concentrated proppant stimulation fluid to match in sinusoidal frequency; and maintain the first phasing at a different phasing from the second phasing.

12. A non-transitory computer readable medium storing one or more instructions that, when executed, cause a processor to:

determine a decomposition of a predetermined Fourier transform, wherein the predetermined Fourier transform is based on a predetermined concentration of proppant in a concentrated proppant stimulation fluid to be pumped at pulsed intervals to a location to simulate a square-wave;

associate one or more concentrated proppant stimulation fluid pumps to each of at least two or more orders of the decomposed predetermined Fourier transform;

determine a first rate and a first phasing for pumping a clean fluid from one or more clean fluid pumps;

determine a second rate and second phasing for pumping a concentrated proppant stimulation fluid from the one or more concentrated proppant stimulation fluid pumps based on the associated two or more orders of the decomposition of the predetermined Fourier transform; and wherein the determined first rate and the second rate are based on a target flow rate of a total fluid to the location, wherein the total fluid comprises at least one of the clean fluid and the concentrated proppant stimulation fluid.

13. The non-transitory computer readable medium of claim 12, wherein the one or more instructions further cause the processor to:

associate at least a first one of the one or more concentrated proppant stimulation pumps with a first order of the decomposed predetermined Fourier transform; and associate at least a second one of the one or more concentrated proppant stimulation pumps with a second order of the decomposed predetermined Fourier transform.

14. The non-transitory computer readable medium of claim 12, wherein the one or more instructions further cause the processor to:

determine one or more additional clean fluid pumps; and associate each of the one or more additional clean fluid pumps with a constant rate.

15. The non-transitory computer readable medium of claim 12, wherein the first phasing and the second phasing are 180 degrees out of phase.

16. The non-transitory computer readable medium of claim 12, wherein the first rate and the second rate are determined such that the pumping of the clean fluid at the first rate and the concentrated proppant stimulation fluid match in sinusoidal frequency.

17. The non-transitory computer readable medium of claim 12, wherein the one or more instructions further cause the processor to:

determine a flow rate of the fluid to the location; and alter at least one of the first rate and the second rate based on the flow rate to maintain the target flow rate.

18. The non-transitory computer readable medium of claim 12, wherein the one or more instructions further cause the processor to actuate at least one of the one or more clean fluid pumps to pump an additional clean fluid to maintain the target flow rate of the fluid to the location.

* * * * *